US005421143A

United States Patent [19]

Savigny

[11] Patent Number: 5,421,143

[45] Date of Patent: Jun. 6, 1995

[54] BAG HOLDING AND LOADING DEVICE FOR BAGGER

[75] Inventor: James G. Savigny, Youngstown, N.Y.

[73] Assignee: Ag-Pak, Inc., Gasport, N.Y.

[21] Appl. No.: 317,391

[22] Filed: Oct. 4, 1994

[51] Int. Cl.[6] ..... B65B 41/00; B65B 43/28; B65B 43/30; B65B 67/12

[52] U.S. Cl. ..... 53/572; 53/386.1

[58] Field of Search ..... 53/469, 570, 571, 572, 53/573, 385.1, 386.1, 67

[56] References Cited

U.S. PATENT DOCUMENTS

| | | | |
|---|---|---|---|
| 3,050,918 | 8/1962 | Helm et al. | 53/386.1 |
| 3,495,378 | 2/1970 | Kipers | 53/385.1 X |
| 3,556,316 | 1/1971 | Marasso et al. | 214/8.5 |
| 3,590,553 | 7/1971 | Formo | 53/572 X |
| 3,731,454 | 5/1973 | Crabb | 53/55 |
| 3,789,573 | 2/1974 | Crabb | 53/55 |
| 3,979,879 | 9/1976 | Rudemacher | 53/67 |
| 4,172,349 | 10/1979 | Lipes | 53/459 |
| 4,245,944 | 1/1981 | Van Ginkel et al. | 414/330 |
| 4,291,517 | 9/1981 | Lipes | 53/468 |
| 4,541,228 | 9/1985 | Petersen | 53/572 |
| 4,644,735 | 2/1987 | Savigny | 53/570 |
| 4,715,167 | 12/1987 | Savigny | 53/572 |
| 5,249,409 | 10/1993 | Jensen | 53/459 |

FOREIGN PATENT DOCUMENTS 1308141 2/1973 United Kingdom .

*Primary Examiner*—Horace M. Culver
*Attorney, Agent, or Firm*—Joseph P. Gastel

[57] ABSTRACT

A bag holding and loading device for a bagger having structure for opening a bag and removing a loaded bag from the bag holding and loading device, the bag holding and loading device including a base plate, first and second cylinders mounted on the base plate, first and second piston rods extending in opposite directions from the first and second cylinders, respectively, first and second rear clamping members mounted on the outer ends of the first and second piston rods, respectively, first and second apertures in the first and second rear clamping members, respectively, for receiving wicket pins, first and second rear clamping plates movably mounted on the base member outwardly of the first and second rear clamping members, respectively, for selectively either occupying first positions relative to the first and second rear clamping members, respectively, for permitting wickets of bags to be clamped therebetween or occupying second positions for permitting wickets of bags to be mounted on the first and second rear clamping members, a motor for rotating the plate between bag filling and bag loading positions, and a valve for deactuating the cylinder which is associated with a clamping member which does not have a wicket of bags thereon to permit the rear clamping plate associated therewith to be pivoted into position for permitting a wicket of bags to be mounted thereon.

16 Claims, 9 Drawing Sheets

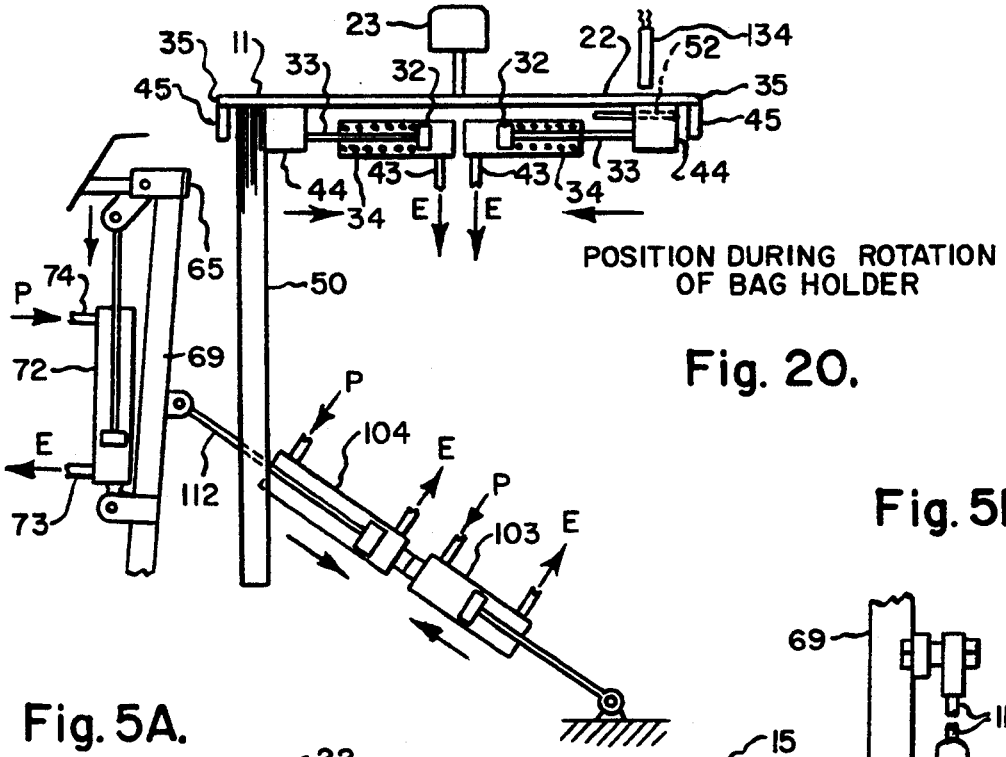
Fig. 20.
Fig. 5B.
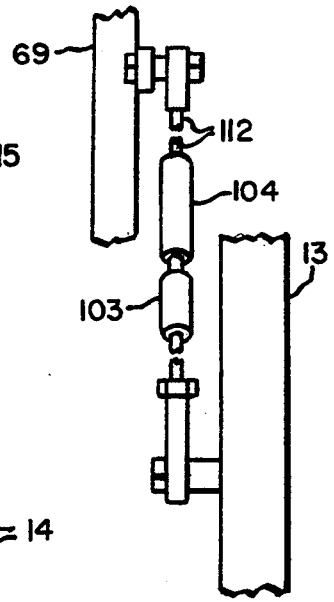
Fig. 5A.
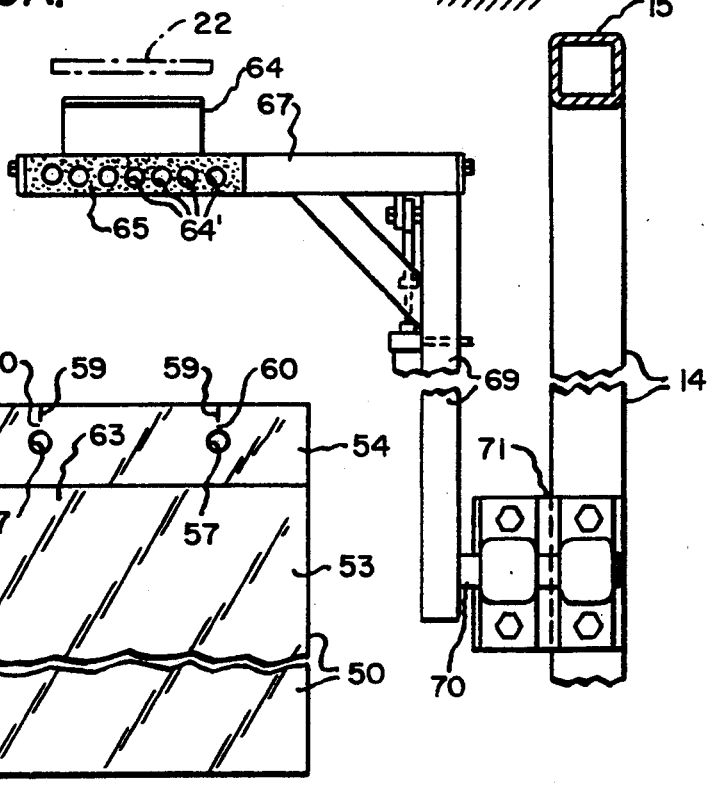
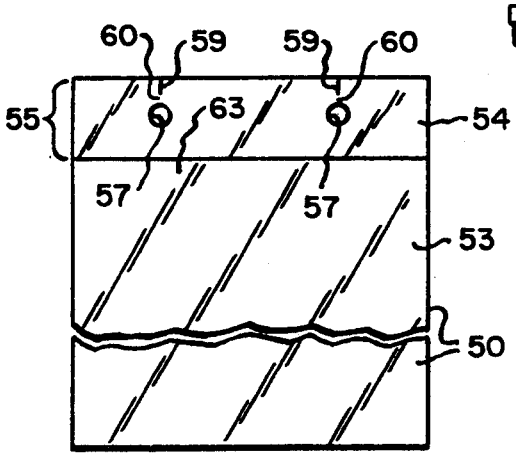
Fig. 22.

Fig. 6.
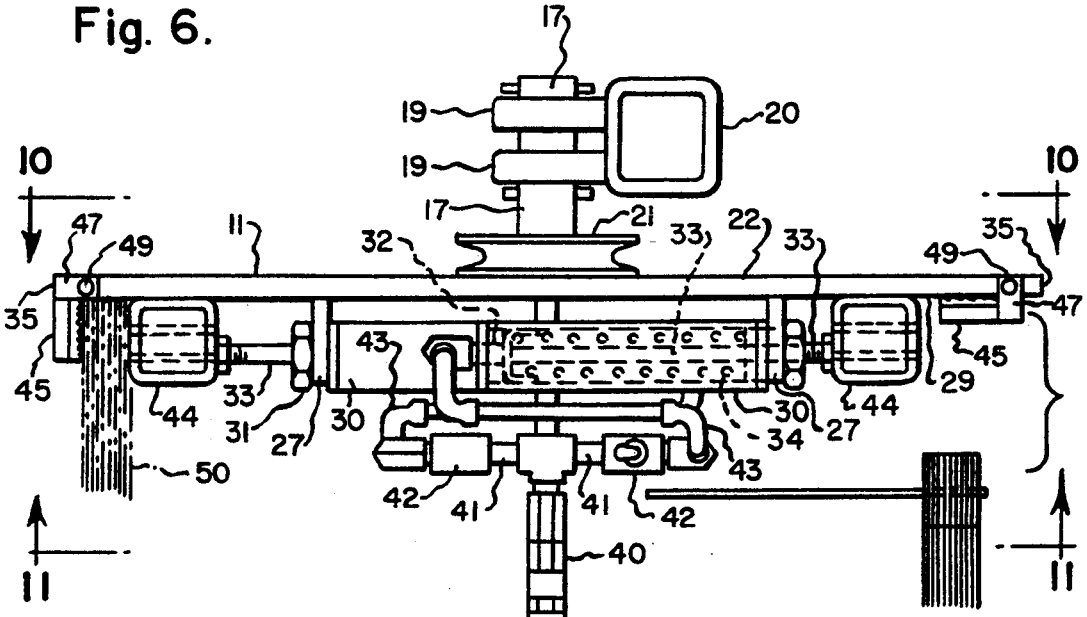
Fig.8.
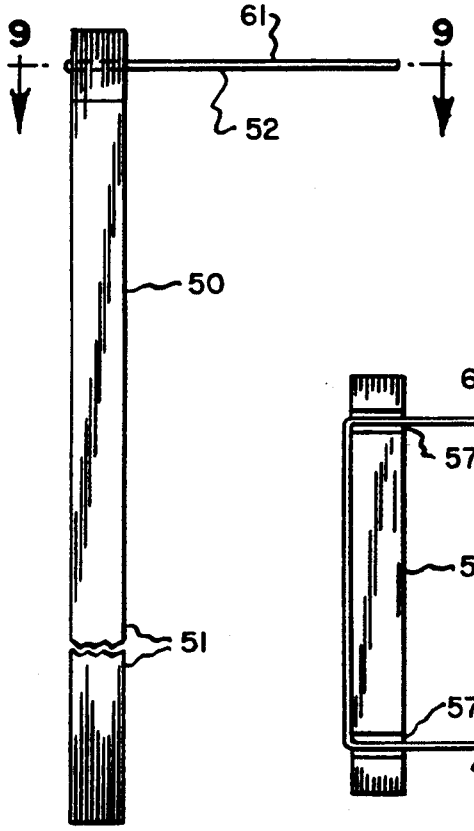
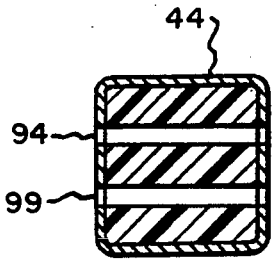
Fig. 7.
Fig. 9.
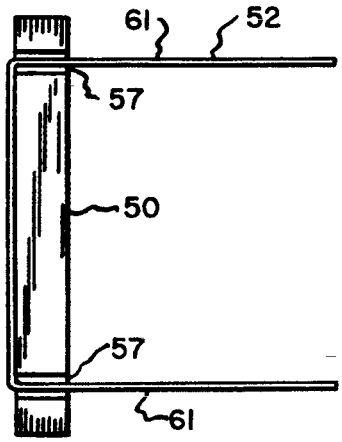

BAG BEING FILLED AND REAR CLAMP MEMBER AGAINST REAR CLAMP PLATE AT EMPTY END

BAG BEING FILLED AND NEW WICKET BEING LOADED

FILLED BAG BEING TAKEN OFF AND NEW WICKET COMPLETELY LOADED

POSITION AT START OF OPENING BAG

BAG FULLY OPEN BEFORE FILLING STARTS

OUT OF BAGS FOR 5 SECONDS

BAG HOLDING AND LOADING DEVICE FOR BAGGER

BACKGROUND OF THE INVENTION

The present invention relates to an improved bag holding and loading device for a bagger.

By way of background, in the operation of a bagger, when the supply of bags being filled is exhausted, new bags must be loaded onto the bag holding device. In the past, on certain baggers the bagger had to be shut down to permit the reloading of the bags. This created objectionable "down" time. In order to overcome this shortcoming, various devices have been made to permit loading of bags while the bagger was in operation. Devices of this type are exemplified in U.S. Pat. Nos. 3,979,879, 3,556,316, 3,590,553, 3,495,378 and 5,249,409. The bag holding and loading device of the present invention is an improvement over those disclosed in the foregoing patents.

SUMMARY OF THE INVENTION

It is accordingly one object of the present invention to provide an improved bag holding and loading device for a bagger which permits loading of a wicket of bags while bags from another wicket are being filled and which is relatively simple in construction and reliable in operation. Other objects and attendant advantages of the present invention will readily be perceived hereafter.

The present invention relates to a bag holding and loading device for a bagger comprising a base plate, first and second cylinders mounted on said base plate, first and second piston rods extending in opposite directions from said first and second cylinders, respectively, first and second rear clamping members mounted on the outer ends of said first and second piston rods, respectively, first and second apertures in said first and second rear clamping members, respectively, for receiving wicket pins, and first and second rear clamping plates movably mounted on said base plate outwardly of said first and second rear clamping members, respectively, for selectively either occupying first relative to said first and second rear clamping members, respectively, positions for permitting wickets of bags to be clamped therebetween or occupying second positions for permitting wickets of bags to be mounted on said first and second rear clamping members.

The present invention also relates to a bagger including a bag filling device for filling bags with product and a bag holding and loading device for holding a first wicket of first bags during filling with product and for permitting the loading of a second wicket of second bags onto said bag holding and loading device while said first bags are being filled, each of said first and second bags having a front panel and a rear panel, an upper edge on said front panel and an upper edge on said rear panel which extends upwardly beyond said upper edge of said front panel, said bag holding and loading device comprising a base plate, first and second cylinders mounted on said base plate, first and second piston rods extending in opposite directions from said first and second cylinders, respectively, first and second rear clamping members mounted on the outer ends of said first and second piston rods, respectively, first and second apertures in said first and second rear clamping members, respectively, for receiving wicket pins, first and second rear clamping plates movably mounted on said base plate outwardly of said first and second rear clamping members, respectively, means for selectively moving said first and second rear clamping plates to first positions for permitting wickets of bags to be clamped between said first and second rear clamping members and said first and second rear clamping plates, respectively, or to second positions for permitting wickets of bags to be mounted on said first and second rear clamping members, said bag filling device comprising means for engaging said upper edge of said front panel of a first bag which is located on the outermost side of said first wicket while said upper edges of said rear panels of said bags of said first wicket are being clamped between said first rear clamping member and said first rear clamping plate to thus pull said front panel of said outermost first bag on said first wicket away from said rear panel of said outermost first bag, means for clamping said upper edge of said front panel of said outermost first bag after said front panel of said outermost first bag has been pulled away a predetermined distance from said rear panel of said outermost bag prior to filling, means for pulling said front panel of said first outermost bag further away than said predetermined distance from said rear panel of said outermost first bag after said bag has been filled, means for causing said first cylinder to move said first rear clamping member away from said first rear clamping plate to terminate clamping of said upper edges of said rear panels of said first bags while said front panel of said first outermost bag is being pulled further away from said rear panel of said first outermost bag to thereby tear said upper edge of said rear panel of said outermost first bag from said first wicket, retracting means for causing said second cylinder to retract said second rear clamping member away from said second rear clamping plate and causing said second rear clamping member to remain in said retracted position until said retracting means are further actuated to cause said second cylinder to move said second rear clamping member toward said second rear clamping plate, said second rear clamping plate being movable to said second position when said second rear clamping member is retracted to thereby permit loading of a second wicket of second bags thereon while said first bags are being cyclically removed from said first wicket.

The present invention will be more fully understood when the following portions of the present invention are read in conjunction with the accompanying drawings wherein:

BRIEF DESCRIPTION OF THE DRAWINGS

FIG. 5A is a fragmentary view taken substantially in the direction of the arrows 5A—5A of FIG. 1 and showing the bag arm structure;

FIG. 5B is a fragmentary view taken in the direction of arrows 5B—5B of FIG. 1 and showing the linkage for actuating the bag arm;

FIG. 6 is an enlarged cross sectional view taken substantially along line 6—6 of FIG. 4 and showing a side elevational view of the bag holding and loading device in the position which it assumes after it has been rotated to a bag filling position and carrying a new load of bags and also showing one of the bag clamping cylinders with the rear clamp member retracted and the rear clamp plate pivoted to a position which permits the loading of a wicket onto the rear clamp member;

FIG. 7 is a cross sectional view of the rear clamp member taken substantially along line 7—7 of FIG. 11;

FIG. 8 is a fragmentary side elevational view of a wicket of bags;

FIG. 9 is a cross sectional view taken substantially along line 9—9 of FIG. 8;

FIG. 10A is a view taken substantially in the direction of arrows 10A—10A of FIG. 10 and showing the face of the rear clamp member;

FIG. 20 is a schematic view showing the bag holding and loading device immediately after it has been rotated to place a new wicket in position to be opened and showing the compressed air flow and exhaust paths during the rotation of the bag holding and loading device;

FIG. 22 is a fragmentary plan view of a bag of the type which is used on the bagger.

DESCRIPTION OF THE PREFERRED EMBODIMENTS

Summarizing briefly in advance, the improved bagger 10 of the present invention is directed to a bag holding and loading device 11 which permits a new wicket of bags to be loaded onto the bagger while a previously loaded wicket of bags is being filled, thereby greatly reducing the "down" time due to the loading of bags.

Figure 1:
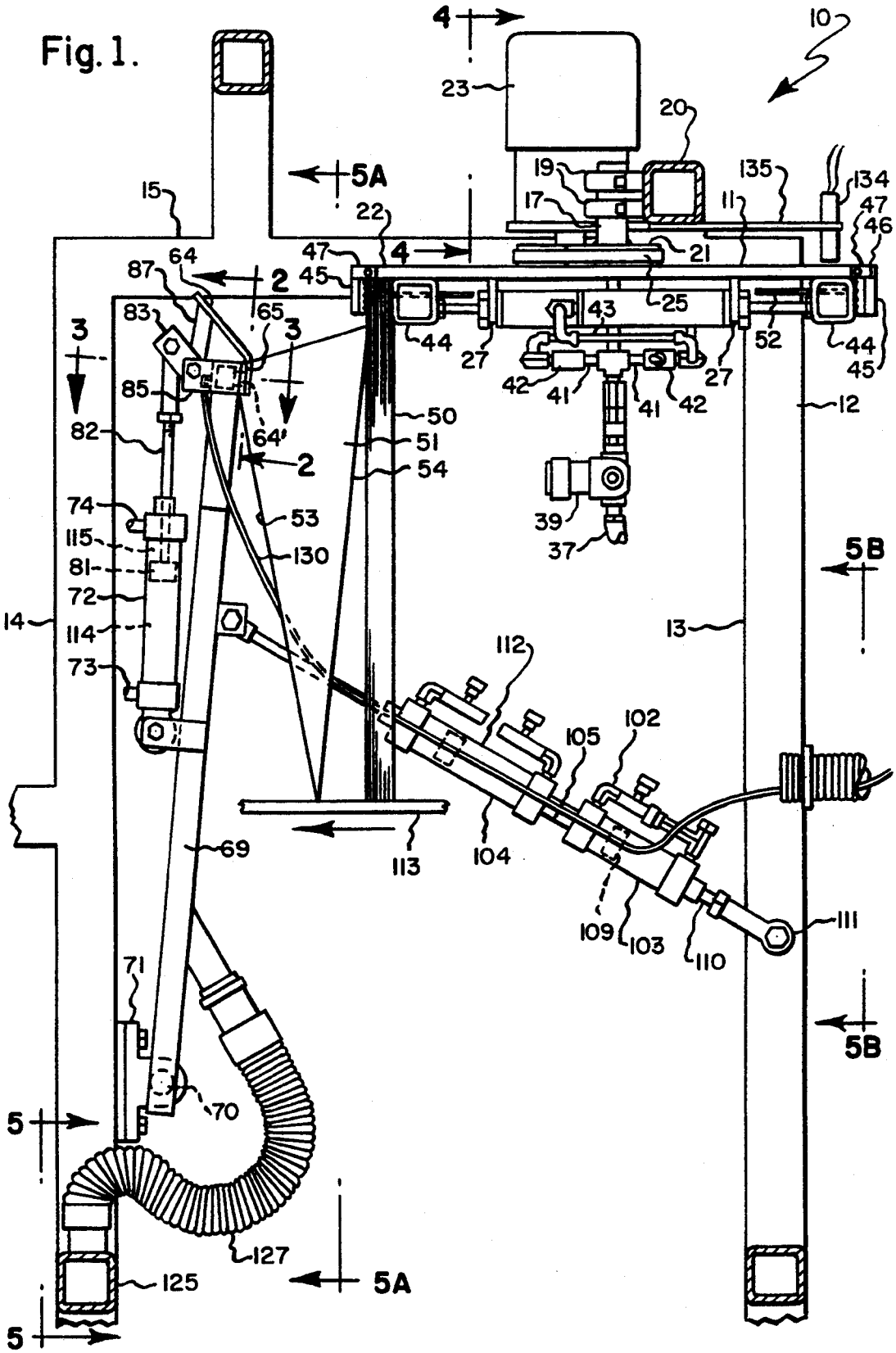
FIG. 1 is a fragmentary side elevational view of a bagging machine mounting the improved bag holding and loading device and showing a bag which is mounted at one end thereof being filled and the other end thereof empty.
Figure 4:
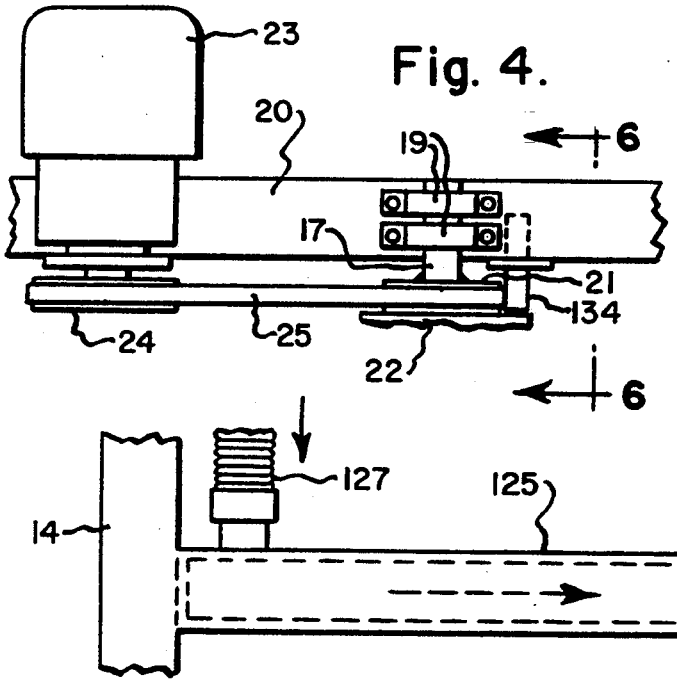
FIG. 4 is a fragmentary view taken substantially in the direction of arrows 4—4 of FIG. 1 and showing the motor structure for rotating the bag holding and loading device.
Figure 5:
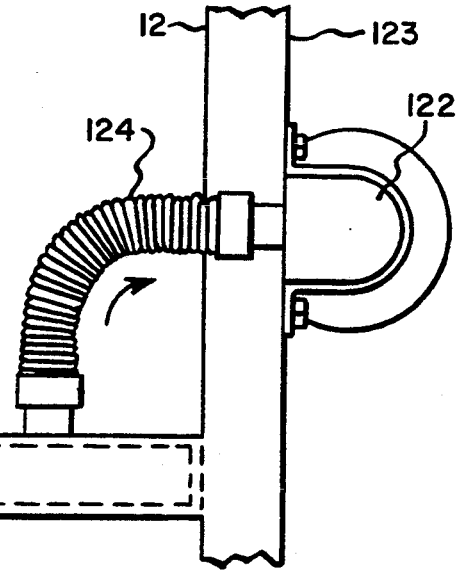
FIG. 5 is a fragmentary view taken substantially in the direction of arrows 5—5 of FIG. 1 and showing a portion of the vacuum path to the suction face.

A bagger 10 is fragmentarily shown in FIG. 1 and it includes a frame 12 which includes legs 13 and 14 which are connected by a beam 15 at their upper ends. A bag holding and loading device 11 includes a shaft 17 (FIGS. 1, 4 and 6) which is journaled for rotation in bearings 19 suitably secured to a beam 20 of the frame. A pulley 21 is welded to shaft 17 and to base plate 22. A motor 23 is suitably attached to beam 20 (FIG. 4), and it drives pulley 24 which is coupled to pulley 21 through belt 25. Thus, when motor 23 is caused to rotate, it will rotate base plate 22. It is to be noted that cross member 15 (FIGS. 1 and 5A) is located behind plate 22 in FIG. 1, and thus plate 22 will not contact frame member 15 when it rotates.

Mechanism for holding and loading bags is mounted on plate 22. More specifically, plates 27 are welded to side 29 of plate 22. Cylinders 30 are secured to plates 27 by nuts 31 which clamp plates 27 between them and the ends of the cylinders by threading onto hollow screw portions 28 (FIG. 11) extending outwardly from the ends of the cylinders. Each cylinder includes a piston 32 (FIGS. 6 and 14) mounted on a piston rod 33, and a spring 34 encircles each piston rod 33 for biasing the pistons 32 in directions away from their corresponding ends 35 of the plate 22. A compressed air inlet hose 37 leading from a suitable compressed air source is connected to cylinders 30 through pressure reducer 39 (FIG. 6), conduit 40, conduits 41 (FIG. 11), manually actuatable valves 42 and conduits 43.

Figure 10:
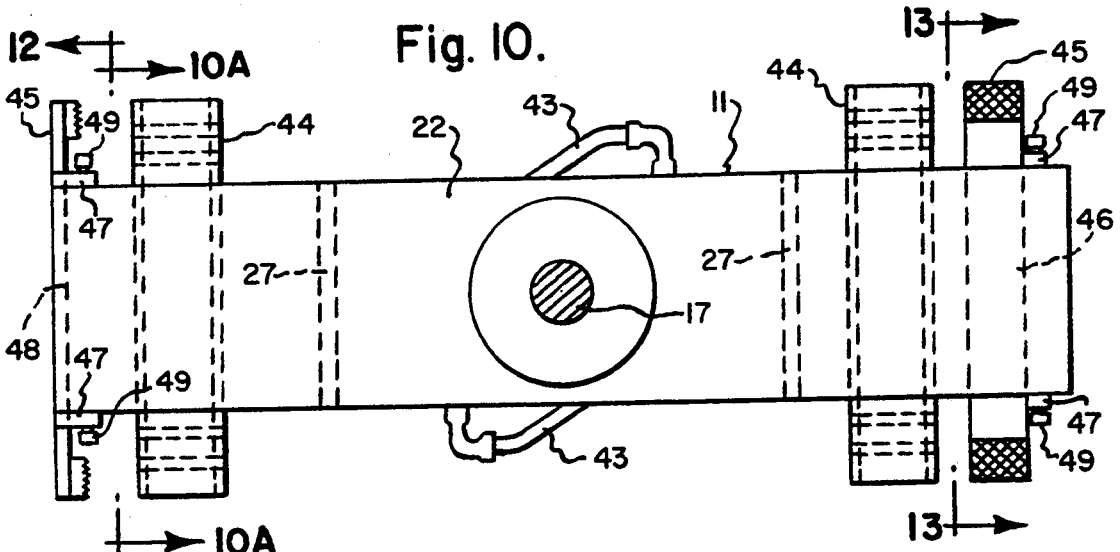
FIG. 10 is a top plan view, partially in cross section, of the bag holding and loading device taken substantially along line 10—10 of FIG. 6.
Figure 11:
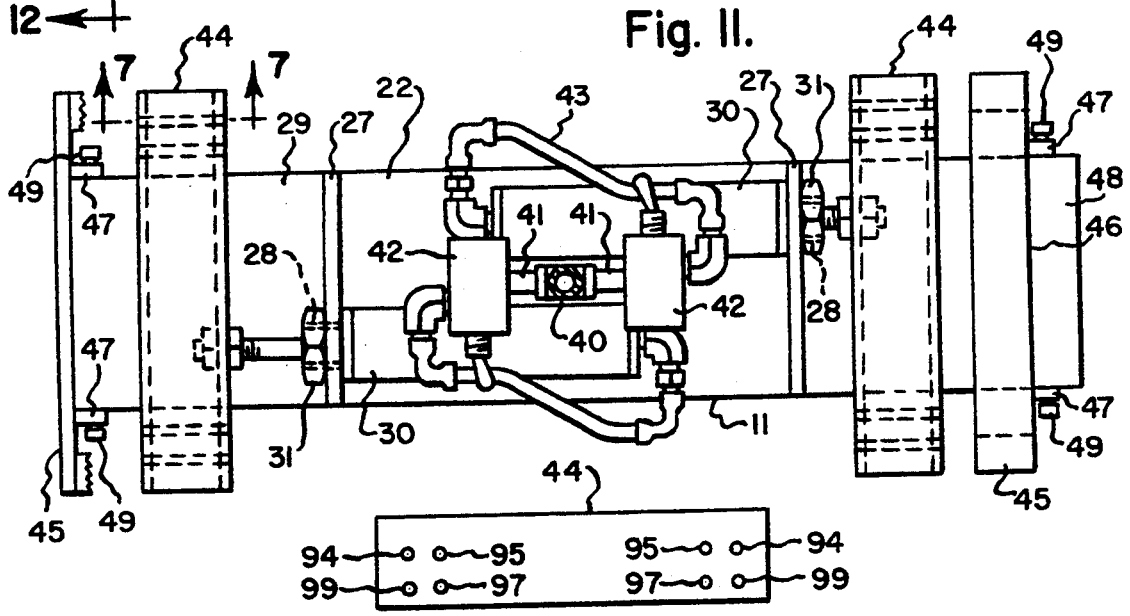
FIG. 11 is a bottom plan view of the bag holding and loading device taken substantially in the direction of arrows 11—11 of FIG. 6.

The outer end of each piston rod 33 is secured to a rear clamp member 44. Pivotally mounted at the outer ends 35 of plate 22 are rear clamp plates 45. In this respect, each clamp plate 45 has ears 47 (FIGS. 6, 10 and 11) welded thereto which are pivotally mounted on the side edges of plate 22 by means of pins 49. Thus, each rear clamp plate 45 can pivot between the horizontal and vertical positions shown at the opposite ends of plate 22 (FIGS. 6, 10 and 11).

In accordance with the present invention, when the bags 51 of wicket 50 (FIG. 8) are being filled with product at one end of the plate 22, a new wicket of bags can be mounted on the opposite end of plate 22, and when the supply of bags is exhausted at the end being filled, plate 22 is automatically rotated to place the new wicket of bags in position for filling, and then the end of plate 22 which no longer has a wicket of bags thereon can be manually reloaded with a new wicket of bags.

The improved bag holding and loading device 11 operates in the following manner, starting with the condition shown in FIG. 1 wherein a bag 51 on wicket 50 is being filled and the opposite end of plate 20 has not yet been loaded with a new wicket but it still carries the wicket pin 52 of a previous wicket of bags. Each plastic bag 51 (FIG. 22) which is a part of the wicket 50 has the following structure. It has a front panel 53 and a rear panel 54 which has an upper edge portion 55 which extends upwardly beyond the top of the front panel. Holes 57 are formed in edge portion 55 which has slits 59 leading toward holes 57 and which has unslitted portions 60 between slits 59 and holes 57. The legs 61 of wicket pin 52 pass through holes 57 and, as will become apparent hereafter, when the bag 51 is pulled from wicket pin 52, the unslitted portions 60 will tear easily to permit the bag 51 to be separated from bag holding and loading device 11.

Figure 2:
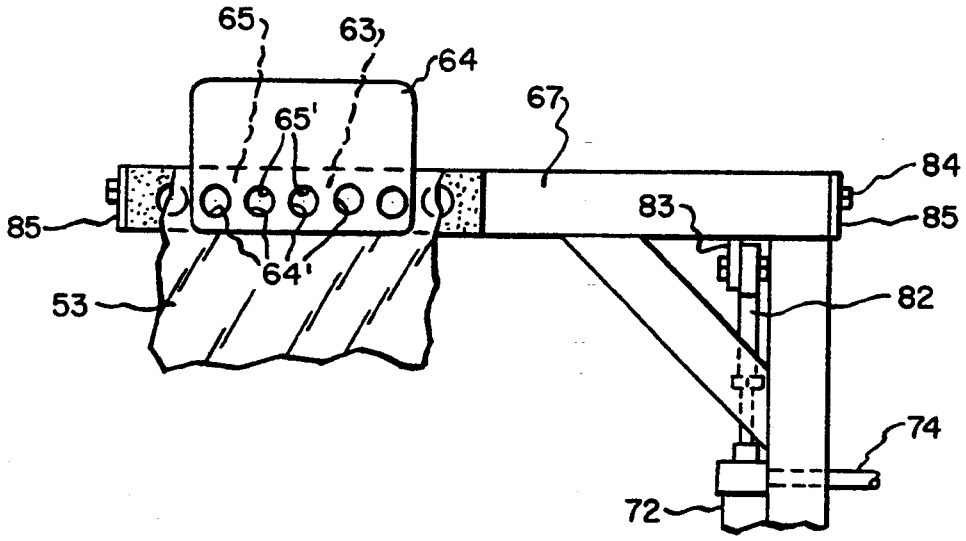
FIG. 2 is a fragmentary view taken substantially in the direction of arrows 2—2 of FIG. 1 and showing the suction face of the suction arm for pulling one side of a bag to an open position and also showing the front clamp plate in position against the suction face of the bag opening arm.
Figure 3:
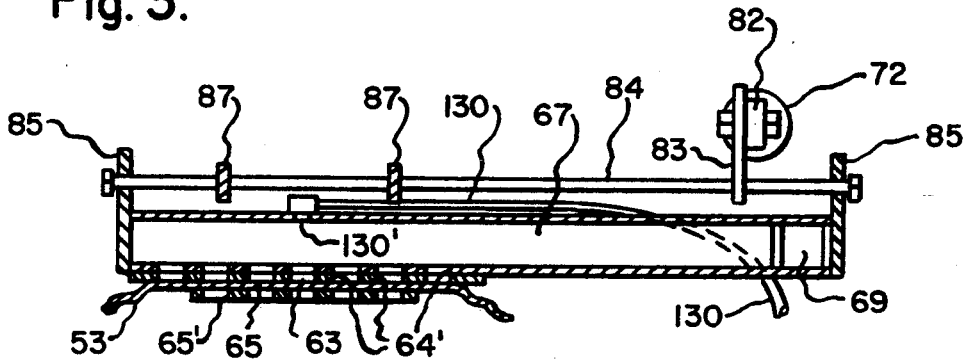
FIG. 3 is a fragmentary cross sectional view taken substantially along line 3—3 of FIG. 1 and showing the suction face and the front clamp plate with a portion of a bag therebetween.
Figure 14:
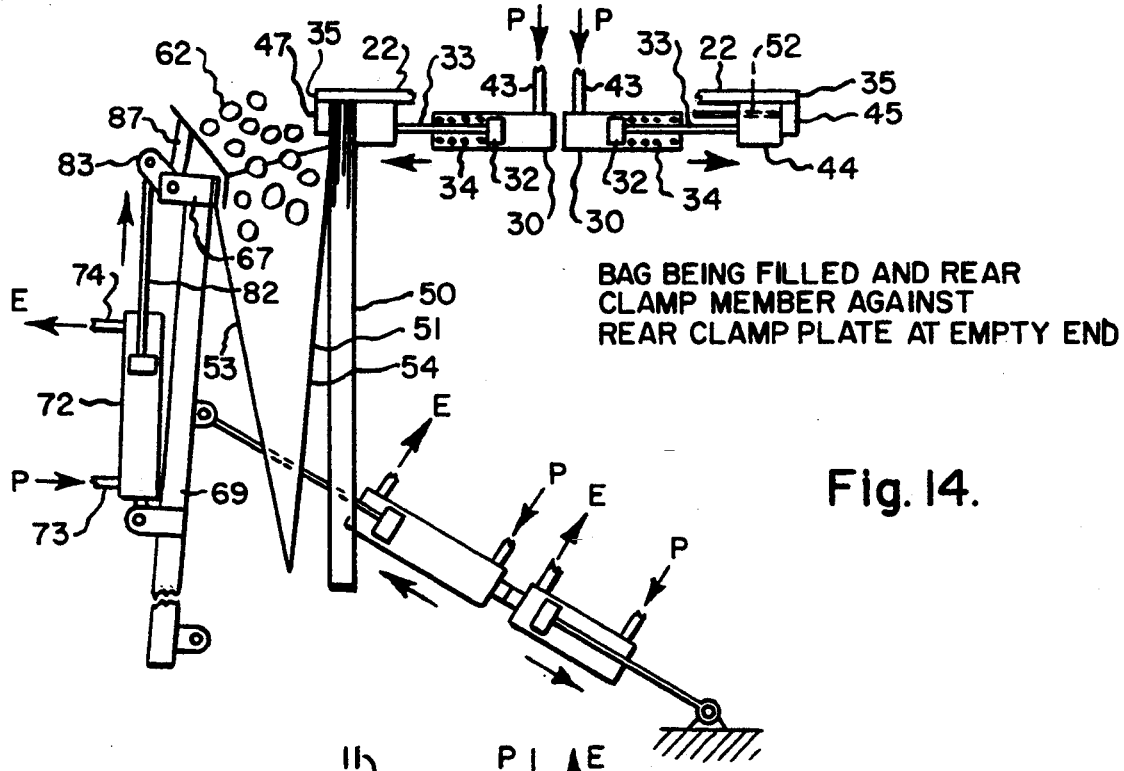
FIG. 14 is a schematic view showing an open bag being filled and showing the compressed air flow and exhaust relative to the various cylinders and also showing the wicket pin of the prior wicket not yet removed from the empty end.
Figure 21:
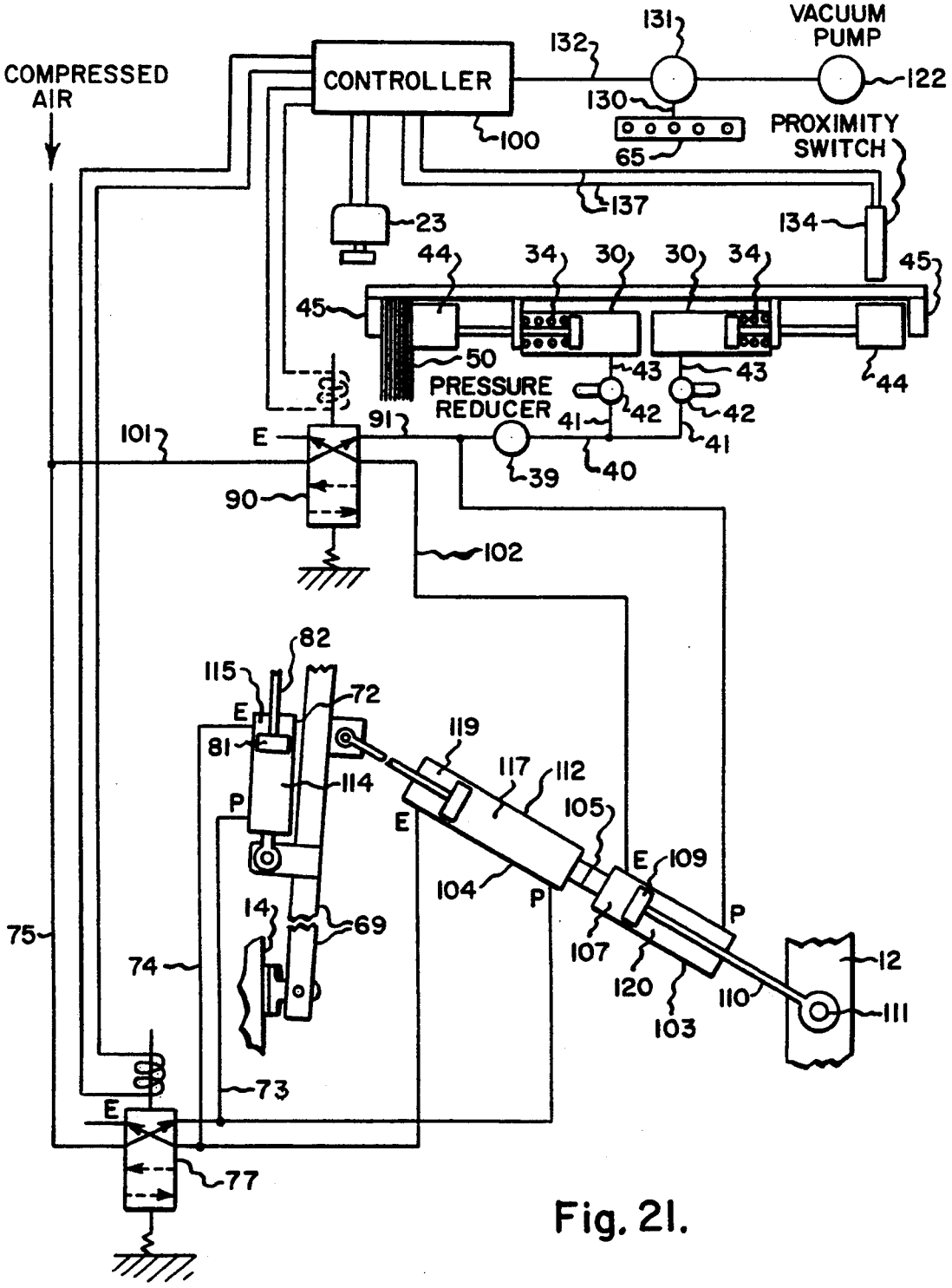
FIG. 21 is a schematic diagram showing the electrical and pneumatic circuits in association with the various cylinders, valves and electrical control.

In FIG. 14 the bag is shown as being filled, and the various parts correspond to the positions shown in FIG. 1. When the bag 51 is being filled with product, such as produce 62, the upper edge portion 63 (FIG. 2) of the bag front panel 53 is clamped between front clamp face 64 and suction face 65 (FIGS. 1, 2 and 3). The suction face 65 (FIG. 5A) is a part of suction arm 67 which is hollow and is mounted at the upper end of bag arm 69 which has a shaft 70 at its lower end pivotally mounted in bearing 71 which is mounted on frame leg 14. The front clamping face 64 is in the clamping position clamping bag edge portion 63 between it and suction face 65 by virtue of the fact that compressed air is being supplied to cylinder 72 through its conduit 73 while permitting the cylinder to be exhausted from conduit 74. This condition is shown in FIG. 21 wherein compressed air flows from main compressed air conduit 75 through valve 77 and conduit 73 to cylinder 72 while permitting the cylinder to be exhausted through conduit 74 and valve 77. At this time the piston 81 will be in the position shown in FIGS. 1 and 21, and piston rod 82 will be extended. The outer end of piston rod 82 is pivotally attached to link 83 (FIGS. 1 and 3) which is keyed to shaft 84 (FIG. 3) journaled between plates 85. Links 87 which are affixed to shaft 84 are fixedly secured to front clamp face 65. Thus, the front clamp face 65 will clamp the upper edge portion 63 of the front panel 53 of the bag between it and the suction face 65 of suction arm 67 when compressed air is supplied to conduit 73 of cylinder 72.

At this point it will be noted that for ease of explanation, in the schematics of FIGS. 14–20, the letter "P" will denote that compressed is being applied to a particular port of a cylinder and the letter "E" will denote the port of each cylinder which is being exhausted.

While the bag 51 is being filled, the upper edge portions 55 of the rear panel 54 is effectively clamped between rear clamp plate 47 and rear clamp member 44. This is the situation at this stage because compressed air is being supplied to conduit 43 leading to cylinder 30 so that all of the top edge portions 55 of all of the bags 51 on wicket 50 are clamped between rear clamp plate 47 and rear clamp member 44. At this time, considering that the plate 22 has just been rotated, and nothing further has been done, compressed air is also being supplied to conduit 43 leading to the other cylinder 30 which has its rear clamp member 44 bearing against rear clamp plate 47 with the wicket pin 52 still in position (FIGS. 1 and 14). The foregoing occurs because compressed air is being supplied from compressed air conduit 75 through valve 90 (FIG. 21), conduit 91, pressure reducer 92, valves 42 and conduits 43 to cylinders 30.

Figure 12:
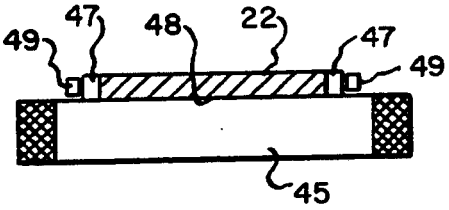
FIG. 12 is a cross sectional view taken substantially along line 12—12 of FIG. 10 and showing the rear clamp plate in a bag clamping position.
Figure 13:
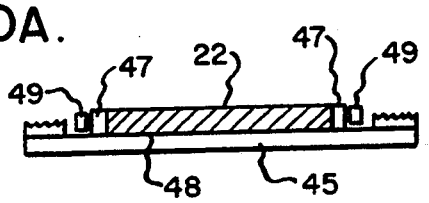
FIG. 13 is a cross sectional view taken substantially along line 13—13 of FIG. 10 and showing the rear clamp plate in a pivoted position for permitting a wicket to be loaded onto the rear clamp member.
Figure 15:
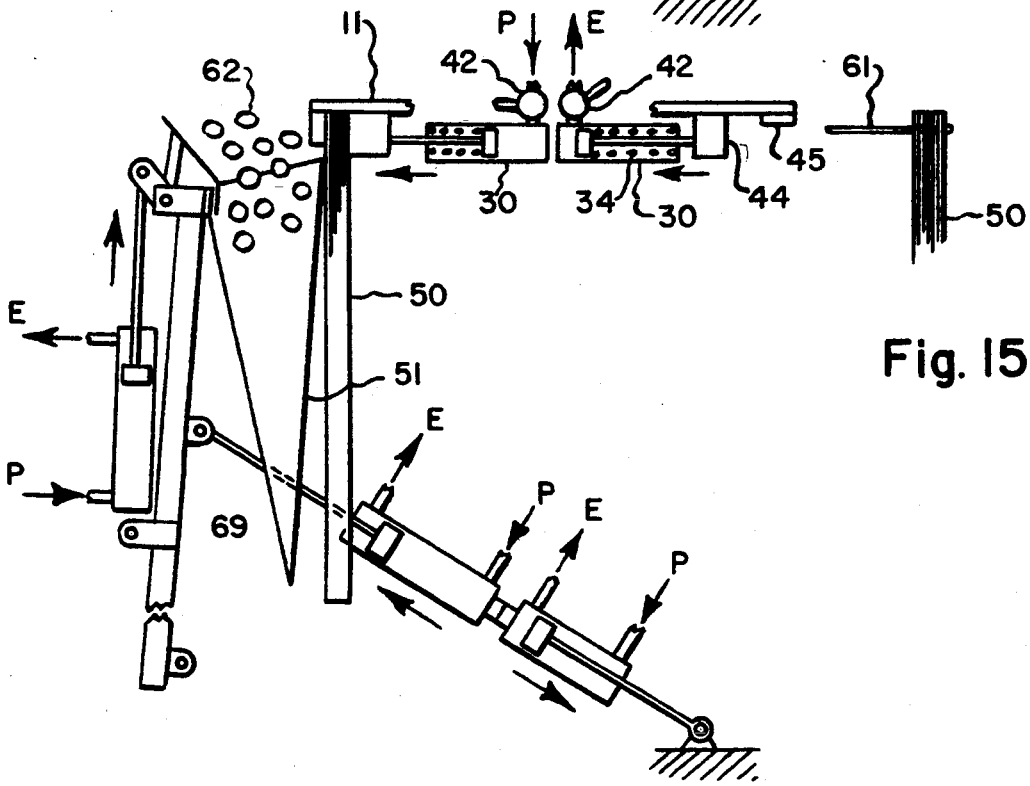
FIG. 15 is a schematic view of a bag being filled and a new wicket being loaded and also showing the compressed air flow and exhaust paths under these circumstances.
Figure 16:
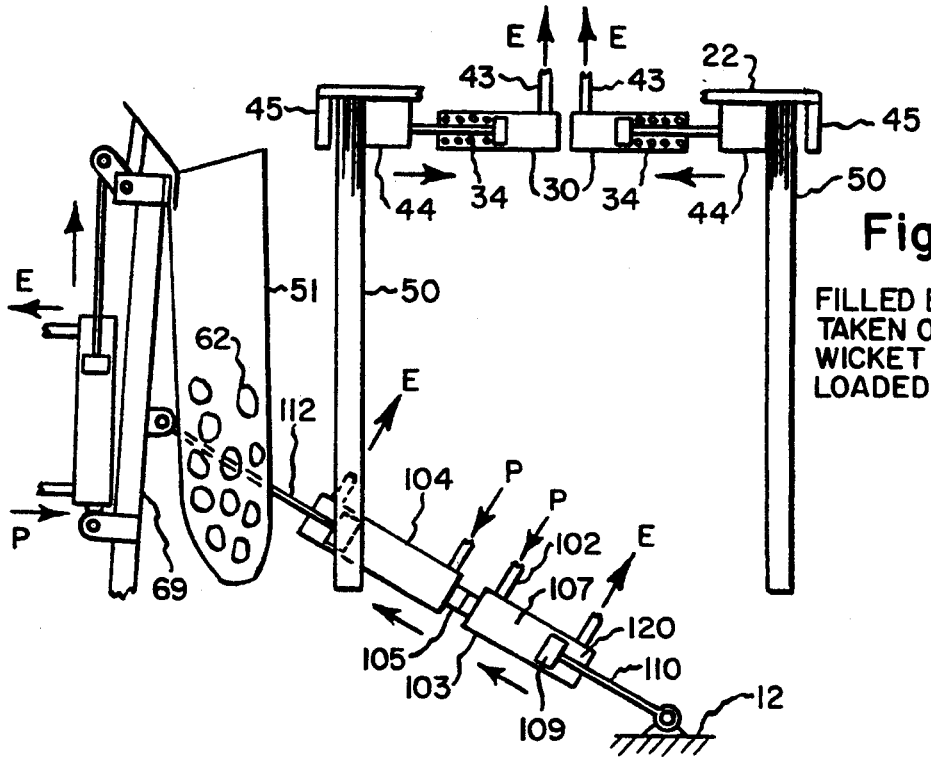
FIG. 16 is a schematic view of a filled bag being taken off of the machine and showing the compressed air and exhaust paths relative to the various cylinders under these circumstances and also showing a new wicket completely loaded but not clamped.

Bags will continue to be filled and removed from wicket 50 at a rate of possibly 50 per minute. The various stages in opening, filling and removing each bag 51 from the left end of the device 11 will be explained hereafter. However, during this process a new wicket 50 can be mounted on the right end of the device 11 as shown in FIG. 15. In this respect, the valve 42 (FIGS. 1, 6, 15 and 21) is manipulated to vent the right cylinder 30 and simultaneously shut off the flow of compressed air thereto which will permit spring 34 to expand to retract rear clamp member 44. This will permit rear clamp plate 45 to be pivoted by manual manipulation to the horizontal positions shown in FIG. 15 and FIG. 10, which will provide the necessary clearance to remove the empty wicket pin 52 from rear clamp member 44 and will provide the necessary clearance to install a new wicket 50 by inserting the legs 61 of wicket pin 52 into a pair of holes, such as 94 (FIG. 10A), in the rear clamp member 44. In this respect it is to be noted that there are numerous pairs of holes in rear clamp member 44 (FIG. 10A). More specifically, there is a pair 94, a pair 97 and a pair 99. The various pairs are used to accommodate wicket pins of different sizes inasmuch as different sized bags may be mounted on different sizes of wicket pins. After the new wicket has been installed, the rear clamp plate 45 is pivoted to back the position shown in FIG. 14 and valve 42 is manipulated to readmit compressed air to cylinder 30, to thereby drive rear clamp member to a clamping position against the bias of spring 34. It is also to be noted that rear clamp plate 45 cannot pivot beyond its vertical position because its edge 46 will abut the underside 48 of plate 22 (FIGS. 1, 10 and 12).

Figure 17:
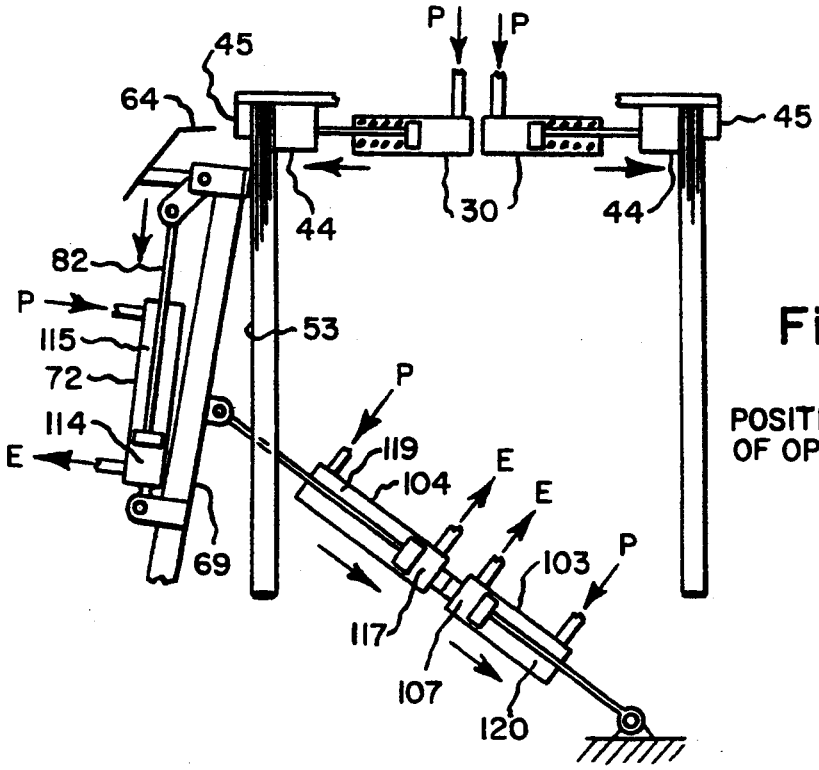
FIG. 17 is a schematic view showing the various parts in a position when one side of a bag is being initially contacted by the suction face and showing the compressed air flow and exhaust relative to the various cylinders under this condition.

After each bag has been filled, it is automatically removed from the bag holding and clamping device 11. This is accomplished, as shown schematically in FIG. 16. A timer within controller 100 will actuate a solenoid to cause valve 90 (FIG. 21) to shift to its dotted line position to thereby cause cylinders 30 to be vented through conduits 43, valves 42, pressure reducer 39, conduit 91, and valve 90 to exhaust. This will permit springs 34 to expand to thereby retract rear clamp members 44 so that they no longer clamp the top edge portions 55 of bags 51 against rear clamp plates 47. Simultaneously, flow of compressed air will pass from the compressed air line through conduit 101 and conduit 102 to bag push cylinder 103. At this point it is to be noted that bag push cylinder 103 and bag opening cylinder 104 are tied together at 105. Therefore, as compressed air is fed to chamber 107, the entire cylinder 103 will move while its piston 109, which has its rod 110 pivotally mounted at 111 to frame leg 12, will thus cause arm 112 to extend to thereby cause bag arm 69, which is pivotally mounted on leg 14, to pivot in a counterclockwise direction and thus rip bag 50 from its wicket pin 52 by rupturing the unslitted bag portions 60. The bag which is thus separated from its wicket will then rest on a conveyor 113 which will move it into a bag tying mechanism (not shown) which ties the neck of the bag. After the neck is tied, the timer causes valve 77 (FIG. 21) to shift to its dotted line position to thereby cause the chamber 114 of front clamp cylinder 72 to be routed to exhaust through conduit 73 and cause chamber 115 to be placed in communication with source of compressed air through conduit 74 to thereby cause piston rod 82 to retract front clamp face 64 to an open position, such as shown in FIG. 17 to thereby release the bag 51. Simultaneously, the flow of compressed air to bag open cylinder 104 is reversed so that chamber 117 will be vented and chamber 119 will be placed in communication with the source of compressed air so that bag arm 69 will be pivoted in a clockwise direction to the position shown in FIG. 17. At this time valve 90 will return to its solid line position of FIG. 21 to thereby cause bag push cylinder 103 to have its chamber 120 placed in communication with the source of compressed air and chamber 107 vented to thereby move the cylinder 103 bodily to the right. At the same time, pressure flow is again reinstituted to rear clamp cylinders 30 to thereby move rear clamp members 44 into clamping position to clamp wickets 50 securely against rear clamp plates 45.

Figure 18:
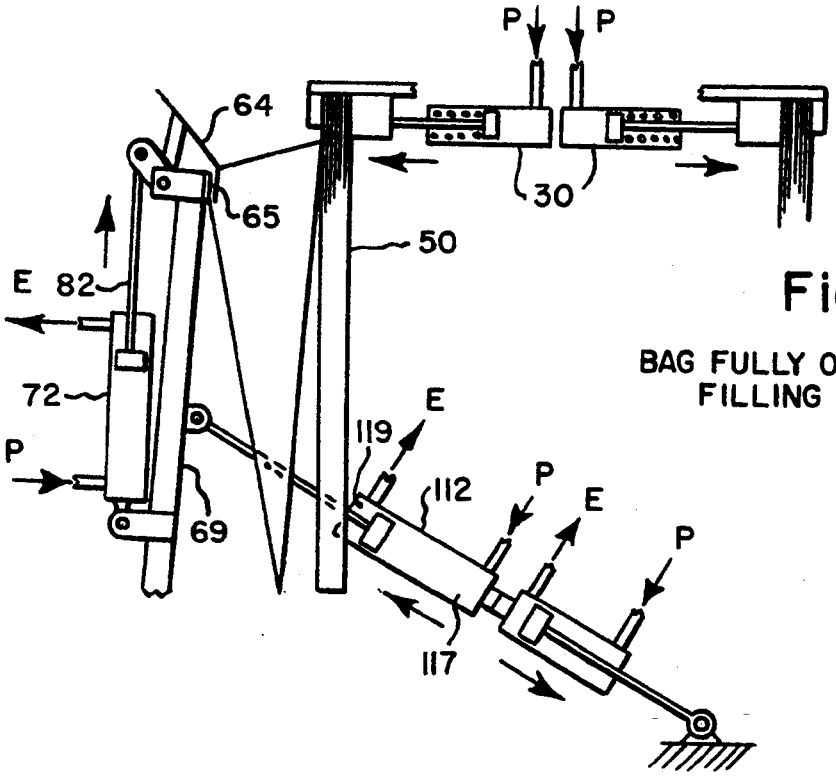
FIG. 18 is a schematic view of the bag being moved to a fully opened position before filling starts and showing the compressed air flow and exhaust relative to the various cylinders in this situation.

As a result of all of the foregoing changes, the bag arm 69 is now in the position shown in FIG. 17 wherein the suction face 65 engages the upper edge portion of front panel 53 of a bag 51. Suction is supplied to suction face 65 in the following manner. A vacuum pump 122 (FIG. 5) which is suitably mounted on a leg 123 of frame 12 creates suction in flexible conduit 124 which is in communication with hollow frame member 125 which is in turn in communication with flexible conduit 127 (FIGS. 5 and 1) which is in communication with hollow bag arm 69 which in turn is in communication with arm 67 which has holes 64' of suction face 65 therein which provide the suction which is thus created to cause the upper edge portion 63 of the front panel 53 of the bag 51 to adhere to arm 67 to thereby provide the attachment which will ultimately pull the front panel 53 away from rear panel 54 and clamp the upper edge portion 63 when the flow of compressed air and the exhaust to cylinders 104 and 72 are reversed from the positions of FIG. 17 to the position of FIG. 18. In this respect, the upper edge portion 63 of the front panel 53 will be pulled away after valve 77 has shifted to the solid line position shown in FIG. 21 so as to cause compressed air to flow to chamber 117 of cylinder 104 and chamber 119 to be exhausted to pivot bag arm 69 in a counterclockwise direction from the position of FIG. 17 to the position of FIG. 18 and thus pull panel 53 to an open position. Simultaneously piston rod 82 will move upwardly and thus cause front clamp face 64 to clamp the upper edge of the front panel 53 against suction face 65. The compressed air flows and exhausts are depicted in FIG. 18. It is to be noted that front clamp face 64 has apertures 65' therein which overlie apertures 64' of suction face 65 so that a false bag gripping signal is not communicated to controller 100 in the event that a bag is not gripped between suction face 65 and front clamp plate 64. More specifically, if cylinder 72 is in the position shown in FIG. 1 with clamp face 64 against suction face 65 and with cylinder 104 moving toward the position shown in FIG. 1 and no suction being sensed in conduit 130 because holes 64' in suction face 65 are not obstructed, the controller 100 will cause the bag arm to move toward the wicket again and front clamp face 64 will be retracted so that an attempt will be made to engage the front panel of a bag to pull it to an open position. The controller 100 is programmed so that if three unsuccessful attempts are made for the suction face 65 to engage and pull the top edge of the front panel to an open position, the bagger will shut down so that the problem can be investigated.

The cycles of bag filling and bag removal as depicted in FIGS. 14–18, and as explained relative to FIG. 21, will continue in response to the intelligence and timing provided by controller 100. Furthermore, as noted above, while the bags are being filled and removed from the left end of the bag holding and clamping device 11, a new wicket 51 can be mounted on the right end of device 11 as explained relative to FIG. 15.

Figure 19:
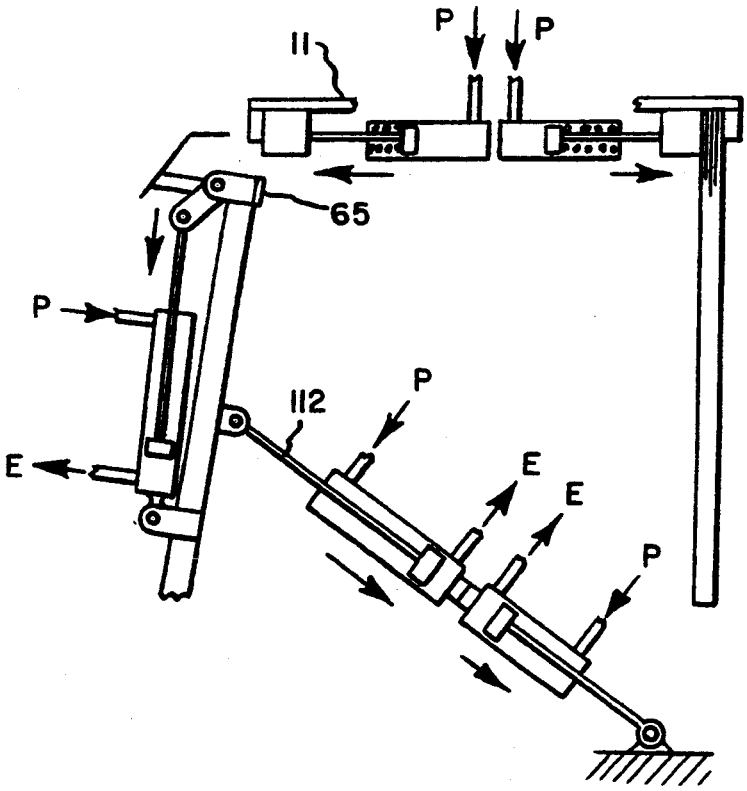
FIG. 19 is a schematic view of the positions of the various parts and the compressed air flow to the various cylinders after the control has sensed that all bags on one side of the bag holding and loading device have been removed.

A point will be reached when the wicket 50 at the left end of plate 22 is exhausted, that is, all bags have been removed, as schematically depicted in FIG. 19. At this time the compressed air and exhaust flows will be as depicted in FIG. 19. Furthermore, at this time there is no upper edge portion 63 of a front panel 53 of a bag against suction face 65. Therefore, there will be no suction in conduit 130 (FIGS. 1 and 3) which is in communication with the hollow arm 67 through port 130' and is also communication with pressure switch 131 (FIG. 21), which is in communication with the vacuum pump 122. When the controller receives a no-suction signal from vacuum switch 131 via lead 132, and the signal persists for five seconds, the controller will actuate motor 23 to rotate bag holding and loading device 11 180° to place a new wicket, which was loaded onto the right end of plate 22, in position for subsequent filling of the bags. The 180° rotation of device 11 is terminated by the use of a proximity switch 134 (FIGS. 1, 20 and 21) which is mounted on bracket 135 and which overlies plate 22 of device 11 so that when plate 22 has been rotated to the proper position to present the new wicket of bags for filling, a signal is provided to controller 100 through leads 137 to thereby terminate the rotation of motor 23.

The position of the various parts during rotation of device 11 is shown in FIG. 20. In this respect, the controller 100, after receipt of the above signal from vacuum switch 131 to cause it to actuate motor 23, will momentarily actuate valve 90 to its dotted line position to thereby actuate bag push cylinder 103 to extend arm 112 and thus pivot bag arm 69 a small distance counterclockwise to provide clearance for the rotating device 11. At this time, rear clamp members 44 will be retracted by springs 34 because cylinders 30 will be exhausted through conduits 43. After device 11 has reached its final position, as signalled by proximity switch 134 to stop motor 23, the controller 100 will cause valve 90 to return to its solid line position and this will cause the flow to cylinders 103 and 30 to be reversed from the position shown in FIG. 20 to the position of FIG. 18 to cause cylinders 30 to move to their clamping positions and move arm 112 to pivot bag arm 69 toward the full wicket. This will cause the suction face 65 to be moved against the outermost bag of the new wicket. Thereafter, valve 77 will be actuated to its solid line position to cause cylinder 112 to have the flow reversed from the position of FIG. 20 to a position such as shown in FIG. 14 to pull the outer bag panel 53 away and cause cylinder 72 to cause clamping of the upper edge 63 of the front panel.

The foregoing cycle of operation as depicted in FIGS. 14–20 is repeated, and it will be appreciated that the bagger does not experience any down time due to the necessity for reloading bags.

While preferred embodiments of the present invention have been disclosed, it will be appreciated that it is not limited thereto but may be otherwise embodied within the scope of the following claims.

What is claimed is:

1. A bag holding and loading device for a bagger comprising a base plate, first and second cylinders mounted on said base plate, first and second piston rods extending in opposite directions from said first and second cylinders, respectively, first and second rear clamping members mounted on the outer ends of said first and second piston rods, respectively, first and second apertures in said first and second rear clamping members, respectively, for receiving wicket pins, and first and second rear clamping plates movably mounted on said base plate outwardly of said first and second rear clamping members, respectively, for selectively either occupying first positions relative to said first and second rear clamping members, respectively, for permitting wickets of bags to be clamped therebetween or occupying second positions for permitting wickets of bags to be mounted on said first and second rear clamping members.

2. A bag holding and loading device for a bagger as set forth in claim 1 wherein said first and second rear clamping plates are pivotally mounted to swing inwardly toward said first and second rear clamping members, respectively, from said first positions.

3. A bag holding and loading device for a bagger as set forth in claim 2 including a shaft mounted on said base plate, and motor means coupled to said shaft for rotating said base plate between first and second positions.

4. A bag holding and loading device for a bagger as set forth in claim 3 wherein said motor means comprise a motor, a first pulley on said shaft, a second pulley on said motor, and a belt coupling said first and second pulleys.

5. A bag holding and loading device for a bagger as set forth in claim 4 including a switch mounted proximate said base plate and effectively coupled to said motor for causing said motor to terminate rotating movement of said base plate when said base plate has reached a predetermined position.

6. A bag holding and loading device for a bagger as set forth in claim 1 including a shaft on said plate, a motor coupled to said shaft for rotating said base plate, and a switch mounted proximate said base plate and coupled to said motor for causing said motor to terminate rotating movement of said base plate when said base plate has reached a predetermined position.

7. A bag holding and loading device for a bagger as set forth in claim 1 including first and second compressed air conduits in said first and second cylinders for admitting compressed air thereto to move said first and second piston rods, respectively, outwardly from said first and second cylinders, respectively, and first and second springs in said first and second cylinders, respectively, for moving said first and second piston rods into said first and second cylinders, respectively, when compressed air is exhausted from said first and second cylinders, respectively.

8. A bag holding and loading device for a bagger as set forth in claim 7 including a shaft on said plate, a motor coupled to said shaft for rotating said base plate, and a switch mounted proximate said base plate and coupled to said motor for causing said motor to terminate rotating movement of said base plate when said base plate has reached a predetermined position.

9. A bagger including a bag filling device for filling bags with product and a bag holding and loading device for holding a first wicket of first bags during filling with product and for permitting the loading of a second wicket of second bags onto said bag holding and loading device while said first bags are being filled, each of said first and second bags having a front panel and a rear panel, an upper edge on said front panel and an upper edge on said rear panel which extends upwardly beyond said upper edge of said front panel, said bag holding and loading device comprising a base plate, first and second cylinders mounted on said base plate, first and second piston rods extending in opposite directions from said first and second cylinders, respectively, first and second rear clamping members mounted on the outer ends of said first and second piston rods, respectively, first and second apertures in said first and second rear clamping members, respectively, for receiving wicket pins, first and second rear clamping plates movably mounted on said base plate outwardly of said first and second rear clamping members, respectively, means for selectively moving said first and second rear clamping plates to first positions for permitting wickets of bags to be clamped between said first and second rear clamping members and said first and second rear clamping plates, respectively, or to second positions for permitting wickets of bags to be mounted on said first and second rear clamping members, said bag filling device comprising means for engaging said upper edge of said front panel of a first bag which is located on the outermost side of said first wicket while said upper edges of said rear panels of said bags of said first wicket are being clamped between said first rear clamping member and said first rear clamping plate to thus pull said front panel of said outermost first bag on said first wicket away from said rear panel of said outermost first bag, means for clamping said upper edge of said front panel of said outermost first bag after said front panel of said outermost first bag has been pulled away a predetermined distance from said rear panel of said outermost bag prior to filling, means for pulling said front panel of said first outermost bag further away than said predetermined distance from said rear panel of said outermost first bag after said bag has been filled, means for causing said first cylinder to move said first rear clamping member away from said first rear clamping plate to terminate clamping of said upper edges of said rear panels of said first bags while said front panel of said first outermost bag is being pulled further away from said rear panel of said first outermost bag to thereby tear said upper edge of said rear panel of said outermost first bag from said first wicket, retracting means for causing said second cylinder to retract said second rear clamping member away from said second rear clamping plate and causing said second rear clamping member to remain in said retracted position until said retracting means are further actuated to cause said second cylinder to move said second rear clamping member toward said second rear clamping plate, said second rear clamping plate being movable to said second position when said second rear clamping member is retracted to thereby permit loading of a second wicket of second bags thereon while said first bags are being cyclically removed from said first wicket.

10. A bagger as set forth in claim 9 wherein said first and second rear clamping plates are pivotally mounted to swing inwardly toward said first and second rear clamping members, respectively, from said first positions.

11. A bagger as set forth in claim 10 including a shaft mounted on said base plate, and motor means coupled to said shaft for rotating said base plate between first and second positions.

12. A bagger as set forth in claim 11 wherein said motor means comprise a motor, a first pulley on said shaft, a second pulley on said motor, and a belt coupling said first and second pulleys.

13. A bagger as set forth in claim 12 including a switch mounted proximate said base plate and effectively coupled to said motor for causing said motor to terminate rotating movement of said base plate when said base plate has reached a predetermined position.

14. A bagger as set forth in claim 9 including a shaft on said plate, a motor coupled to said shaft for rotating said base plate, and a switch mounted proximate said base plate and coupled to said motor for causing said motor to terminate rotating movement of said base plate when said base plate has reached a predetermined position.

15. A bagger as set forth in claim 9 including first and second compressed air conduits in said first and second cylinders for admitting compressed air thereto to move said first and second piston rods, respectively, outwardly from said first and second cylinders, respectively, and first and second springs in said first and second cylinders, respectively, for moving said first and second piston rods into said first and second cylinders, respectively, when compressed air is exhausted from said first and second cylinders, respectively.

16. A bagger as set forth in claim 15 including a shaft on said plate, a motor coupled to said shaft for rotating said base plate, and a switch mounted proximate said base plate and coupled to said motor for causing said motor to terminate rotating movement of said base plate when said base plate has reached a predetermined position.

* * * * *